US009740170B2

(12) United States Patent
Bertrand et al.

(10) Patent No.: US 9,740,170 B2
(45) Date of Patent: Aug. 22, 2017

(54) OSCILLATOR FOR A CLOCK MOVEMENT

(71) Applicant: ROLEX S.A., Geneva (CH)

(72) Inventors: Jean-Louis Bertrand, Feigeres (FR); Benoit Boulenguiez, Viuz-en-Sallaz (FR); Thomas Cimprich, Renens (CH); Raoul Behrend, Nyon (CH)

(73) Assignee: ROLEX SA, Geneva (CH)

( * ) Notice: Subject to any disclaimer, the term of this patent is extended or adjusted under 35 U.S.C. 154(b) by 0 days.

(21) Appl. No.: 14/353,065

(22) PCT Filed: Oct. 23, 2012

(86) PCT No.: PCT/EP2012/070936

§ 371 (c)(1),
(2) Date: Apr. 21, 2014

(87) PCT Pub. No.: WO2013/064390

PCT Pub. Date: May 10, 2013

(65) Prior Publication Data

US 2014/0247704 A1 Sep. 4, 2014

(30) Foreign Application Priority Data

Oct. 24, 2011 (EP) ..... 11405342

(51) Int. Cl.
*G04B 17/06* (2006.01)
*G04B 17/32* (2006.01)

(52) U.S. Cl.
CPC ..... *G04B 17/063* (2013.01); *G04B 17/06* (2013.01); *G04B 17/32* (2013.01); *G04B 17/325* (2013.01)

(58) Field of Classification Search
CPC ..... G04B 17/06; G04B 17/063; G04B 17/32; G04B 17/325; G04B 17/34; G04B 17/345
(Continued)

(56) References Cited

U.S. PATENT DOCUMENTS 3,002,138 A * 9/1961 Byrnes ..... G04C 3/068 368/169
3,287,799 A 11/1966 Hausherr
(Continued)

FOREIGN PATENT DOCUMENTS

CH 327357 A 1/1958
CH 479105 A * 11/1969 ..... G04B 17/063
(Continued)

OTHER PUBLICATIONS

Hausheer, English Translation of CH 479105, originally published Nov. 14, 1969, full document.*
(Continued)

*Primary Examiner* — Amy Cohen Johnson
*Assistant Examiner* — Daniel Wicklund
(74) *Attorney, Agent, or Firm* — Westerman, Hattori, Daniels & Adrian, LLP

(57) ABSTRACT

An oscillator (10) includes a spiral spring (11) made from a paramagnetic or diamagnetic material and an assembled balance wheel (12) having a shaft (13) on which the following elements are fitted: a balance wheel (14), a plate (15) and a collet (16) rigidly connected with the spiral spring (11). The maximum diameter (Dmax) of the shaft is less than 3.5, or even 2.5, or even 2 times the minimum diameter (D1) of the shaft on which one of the elements is fitted, or the maximum diameter (Dmax) of the shaft is less than 1.6, or even 1.3 times the maximum diameter (D2) of the shaft on which one of the elements is fitted.

28 Claims, 8 Drawing Sheets

(58) Field of Classification Search
USPC ..... 368/169, 170, 175, 177, 324, 325
See application file for complete search history.

(56) References Cited

U.S. PATENT DOCUMENTS

| | | | | |
|---|---|---|---|---|
| 3,335,561 | A * | 8/1967 | Kurosawa | G04C 3/065 368/158 |
| 3,601,975 | A * | 8/1971 | Wuthrich | G04B 17/063 318/127 |
| 3,683,616 | A | 8/1972 | Steinemann et al. | |
| 3,747,325 | A | 7/1973 | Schneider | |
| 5,881,026 | A | 3/1999 | Baur et al. | |
| 2002/0114225 | A1 | 8/2002 | Damasko | |
| 2010/0143179 | A1 | 6/2010 | Sandstrom et al. | |
| 2010/0214880 | A1 | 8/2010 | Rappo et al. | |
| 2013/0294961 | A1 | 11/2013 | Sandstrom et al. | |
| 2014/0198625 | A1 | 7/2014 | Von Gruenigen et al. | |
| 2015/0036466 | A1 | 2/2015 | Mertenat | |

FOREIGN PATENT DOCUMENTS

| | | | |
|---|---|---|---|
| CH | 621669 | A | 2/1981 |
| CH | 700032 | B1 | 6/2010 |
| CN | 1268682 | A | 10/2000 |
| CN | 101589168 | A | 11/2009 |
| CN | 101589347 | A | 11/2009 |
| DE | 202010014253 | U1 | 2/2011 |
| EP | 1039352 | A1 | 9/2000 |
| FR | 1.427.115 | A | 1/1966 |
| FR | 2 268 291 | A1 | 11/1975 |
| JP | H11-071625 | A | 3/1999 |
| JP | 2008-544290 | A | 12/2008 |

OTHER PUBLICATIONS

International Search Report dated Mar. 18, 2013 issued in corresponding application No. PCT/EP2012/070936.

Japanese Office Action dated Oct. 18, 2016 in counterpart Japanese application No. 2014-536289; with English ranslation (8 pages) (CH327357 and FR2268291 cited in the Japanese Office Action are not listed in this IDS since fley were listed in the IDS filed Apr. 21, 2014).

Ohinese Search Report dated Jan. 11, 2016 in counterpart Chinese application No. 2012800521385; English translation (2 pages) (D4 CH327357 and D6 FR1427115 cited in the Chinese search report are not listed in this IDS since they were listed in the IDS filed Apr. 21, 2014).

Chinese Office Action dated Feb. 2, 2016 in counterpart Chinese application No. 2012800521385; with English translation (15 pages).

* cited by examiner

| | Oscillator provided with paramagnetic balance spring | | | |
|---|---|---|---|---|
| | Design according to figures 2 and 3 (prior art) Material of the balance staff | | Design according to 1st embodiment | Design according to 2nd embodiment |
| Mean residual (400 G) | Steel 20 AP | CuBe2 | Steel 20 AP | Steel 20 AP |
| Horizontal position [s/d] | 17.5 | 1.7 | 1.3 | Not measured |
| Vertical position [s/d] | 15.3 | Not measured | 2 | 2 |

OSCILLATOR FOR A CLOCK MOVEMENT

The invention relates to an oscillator of a clock movement. The invention also relates to a clock movement and to a timepiece comprising such an oscillator.

The accuracy with which mechanical watches operate is dependent on the stability of the frequency of the oscillator which is made up of a balance and of a balance spring. However, this frequency is disturbed if the watch is exposed to a magnetic field, which means that a difference in operation before and after the movement is magnetized is observed. This difference in operation may be negative or positive. Whatever its sign, this difference is referred to as "residual effect" or "residual operation" and can be measured in accordance with Standard NIHS 90-10. This standard seeks to certify wristwatches which maintain good timekeeping performance following exposure to a 4.8 kA/m (60 G) magnetic field. However, the wearer of the watch may in daily life have to encounter far stronger magnetic fields of the order of 32 kA/m (400 G). It is therefore appropriate to minimize this effect in relation to fields of such strengths.

The vast majority of balance springs are made of Fe—Ni alloys NIVAROX® alloy for example), with an elastic modulus that is dependent on the state of magnetization. Recent developments have allowed the development of self-compensating balance springs made of paramagnetic materials (Nb—Zr—O alloy, PARACHROM® alloy for example) or diamagnetic materials (silicon covered with a layer of $SiO_2$ for example) which allow a very marked reduction in the residual effect for a magnetic field stronger than 4.8 kA/m, as indicated in FIG. 1. However, a residual effect does remain, notably in the case of a magnetic field with a field strength appreciably greater than 4.8 kA/m, for example 32 kA/m.

In general, the structure of a balance assembled within an oscillator is as indicated by Standard NIHS 34-01. FIG. 3 illustrates such an assembled balance structure. The hub of the balance is attached directly to the balance staff, for example by riveting. It is located and seated by a bearing surface defined by the diameter of a flange present on the shaft, and which is also referred to in the terminology of Standard NIHS 34-01 as the balance seating diameter. A roller, generally machined from CuBe2, on which a pin is located, is driven onto a portion of staff the diameter of which is substantially less than that of the balance seating, irrespective of the balance hub on the other side of the flange. The collet intended to hold the balance spring in position is itself driven, on the other side of the flange, onto a staff portion the diameter of which is likewise substantially less than that of the balance seating as illustrated in FIG. 2. Such a balance structure is dictated as reference given its robustness and the resulting simplicity of assembly. Such an assembled balance structure is notably found in any oscillator provided with a paramagnetic or diamagnetic balance spring. By way of example, patent CH700032 discloses an oscillator provided with at least two balance springs, for example made of silicon, which are mounted on a balance staff as described hereinabove. This oscillator, through the properties of the material chosen for the balance spring, allows a reduction in the residual effect for a magnetic field of the order of 4.8 kA/m, but is unable to minimize it for a magnetic field substantially stronger than 4.8 kA/m, for example of 32 kA/m.

It is an object of the invention to provide an oscillator that overcomes the abovementioned disadvantages and improves on oscillators known from the prior art. In particular, the invention proposes an oscillator which minimizes, or even cancels, the negative or positive residual effect for magnetic fields that the wearer of the watch is likely to encounter in daily life, notably magnetic fields stronger or even substantially stronger than 4.8 kA/m, for example 32 kA/m.

An oscillator according to the invention is defined as an oscillator comprising a balance spring made of a paramagnetic or diamagnetic material and an assembled balance comprising a shaft on which the following elements are mounted: a balance, a roller and a collet secured to said balance spring, characterized in that the maximum diameter (Dmax) of the shaft is less than 3.5 or even 2.5 or even 2 times the minimum diameter (D1) of the shaft on which one of the elements is mounted or in that the maximum diameter (Dmax) of the shaft is less than 1.6 or even 1.3 times the maximum diameter (D2) of the shaft on which one of the elements is mounted.

Various embodiments of an oscillator are defined as follows:

- An oscillator comprising a balance spring made of a paramagnetic or diamagnetic material and an assembled balance comprising a shaft on which the following elements are mounted: a balance, a roller and a collet secured to said balance spring, characterized in that the maximum diameter (Dmax) of the shaft is less than 3.5 or even 2.5 or even 2 times the minimum diameter (D1) of the shaft on which one of the elements is mounted and in that the maximum diameter (Dmax) of the shaft is less than 2 or even 1.8 or even 1.6 or even 1.3 times the maximum diameter (D2) of the shaft on which one of the elements is mounted.
- The oscillator as above, characterized in that the balance shaft is made of steel, notably of profile turning steel.
- The oscillator as above, characterized in that the maximum diameter (D2) of the shaft on which one of the elements is mounted is equal to the maximum diameter (Dmax) of the shaft.
- The oscillator as above, characterized in that the maximum diameter (D2) of the shaft on which one of the elements is mounted and the minimum diameter (D1) of the shaft on which one of the elements is mounted and the maximum diameter (Dmax) of the shaft are equal.
- The oscillator as above, characterized in that the maximum diameter (Dmax) of the shaft is less than 1.1 mm or even less than 1 mm or even less than 0.9 mm.
- The oscillator as above, characterized in that the balance is mounted directly on the shaft.
- The oscillator as above, characterized in that the balance is mounted on the roller.
- The oscillator as above, characterized in that the collet is mounted on the roller.
- The oscillator as above, characterized in that the balance shaft is cylindrical or substantially cylindrical.

A clock movement according to the invention is defined as a clock movement comprising an oscillator as above.

A timepiece according to the invention is defined as a timepiece comprising a clock movement as above or an oscillator as above.

The attached drawings depict, by way of examples, three embodiments of an oscillator according to the invention.

FIG. 1 is a graph showing the residual operation M of various movements according to the magnetic field B to which these movements are subjected. Curve 1 illustrates residual operation M of a movement provided with an oscillator that has a magnetic (NIVAROX® alloy) balance spring. Curve 2 illustrates the residual operation M of a movement provided with an oscillator having a paramagnetic (PARACHROM® alloy) balance spring. Finally, curve 3 illustrates the residual operation M of a movement provided with an oscillator that has a diamagnetic balance spring (silicon covered with a layer of $SiO_2$).

Figure 13:
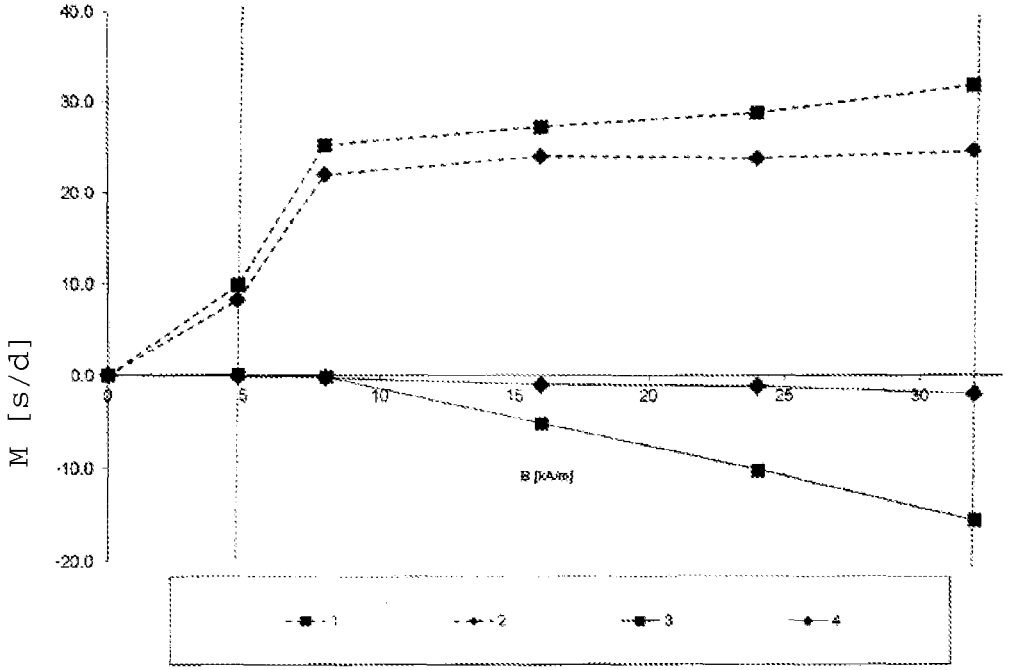

FIG. 13 is a graph showing, by way of comparison, the residual operation M of four movements as a function of the magnetic field B to which they have been subjected, a first movement comprising an oscillator produced according to the first alternative form of the first embodiment of the invention and three movements comprising an oscillator produced according to the prior art. Curve 1 illustrates the residual operation M of a movement provided with an oscillator equipped with an assembled balance provided with a flanged balance staff which is associated with a NIVAROX® alloy balance spring. Curve 2 illustrates the residual operation M of a movement provided with an oscillator equipped with an assembled balance provided with an unflanged balance staff, which is associated with a NIVAROX® alloy balance spring. Curve 3 illustrates the residual operation M of a movement provided with an oscillator equipped with an assembled balance provided with a flanged balance staff which is associated with a paramagnetic balance spring. Finally, curve 4 illustrates the residual operation M of a movement provided with an oscillator made according to the first alternative form of the first embodiment of the invention.

Figure 14:
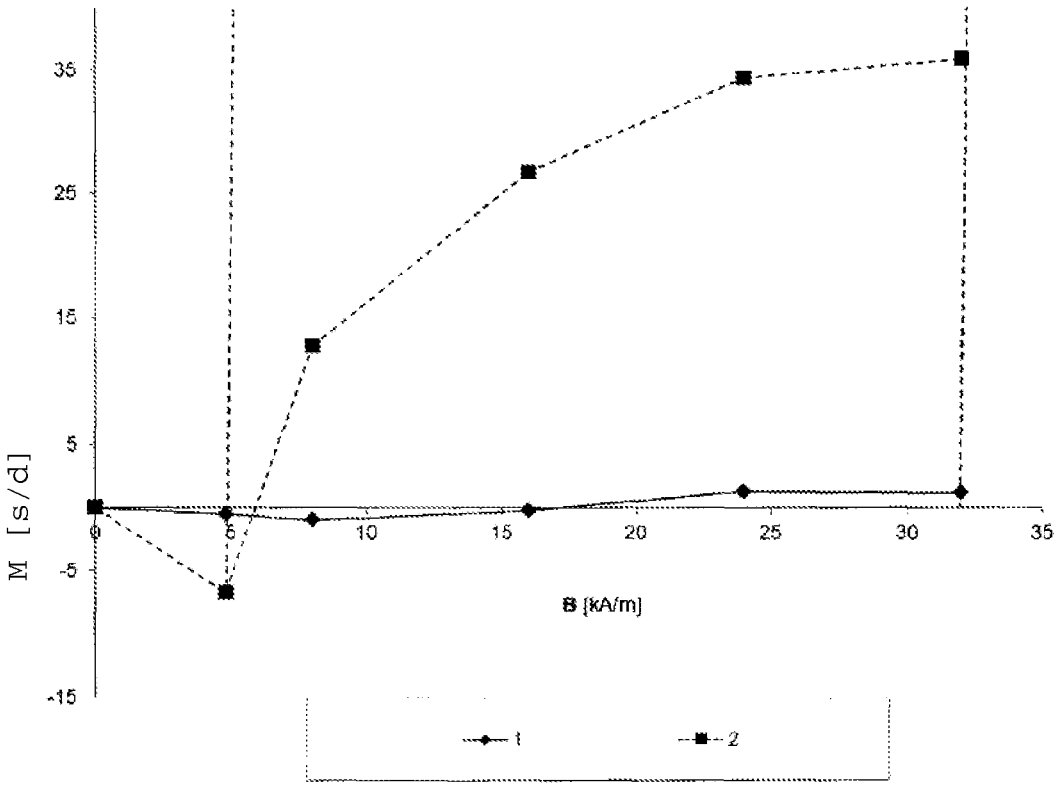

FIG. 14 is a graph showing, by way of comparison, the residual operation M of two movements as a function of the magnetic field B to which they have been subjected, a first movement comprising an oscillator produced according to the first alternative form of the third embodiment of the invention (curve 1 of the graph) and the second movement comprising an oscillator produced according to the prior art and provided with a balance spring of NIVAROX® alloy type (curve 2 of the graph).

Figures 11, 12:
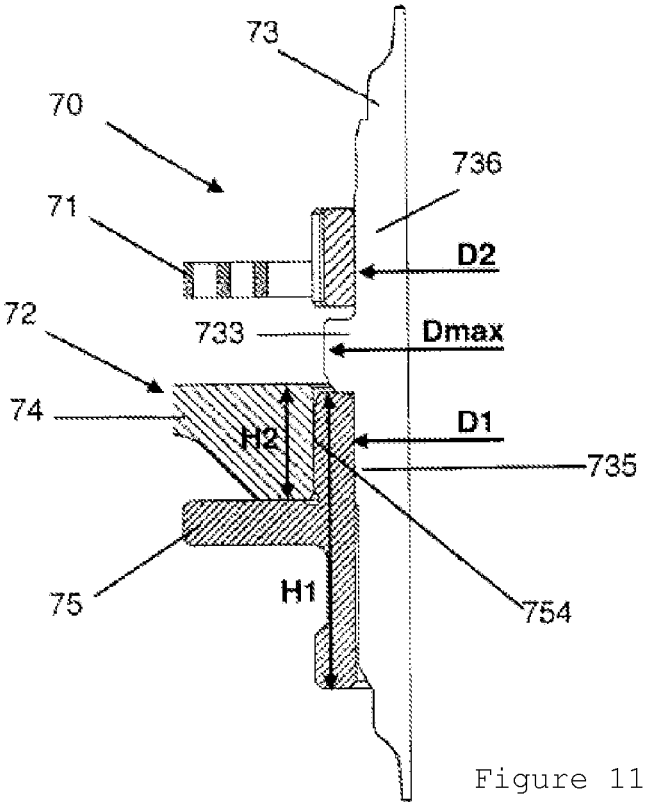
FIG. 11 is a view of a third alternative form of a third embodiment of an oscillator according to the invention.
FIG. 12 is a table showing the residual operation of a movement subjected to a given magnetic field as a function of the material of a balance staff of an oscillator known from the prior art as depicted in FIGS. 2 and 3. It also shows the residual operations of oscillators produced according to a first and a second embodiment of the invention.

The applicant has found that the geometry of the balance staff has a surprising influence on the residual effect. More specifically, following various studies conducted by the applicant company, it was found that by minimizing or even eliminating the largest-diameter portion, referred to according to the terminology of Standard NIHS 34-01 as the balance seating, or more usually even referred to as the "flange" it is possible to minimize the residual effect in the same way as a balance staff made of a paramagnetic material such as CuBe2, as shown by the table of FIG. 12. It is then found that combining a paramagnetic or diamagnetic balance spring with an assembled balance equipped with a flange balance staff according to the prior art does not afford the same effects as combining a paramagnetic or diamagnetic balance spring with an assembled balance equipped with a balance staff according to the invention. More particularly, the act of combining a paramagnetic or diamagnetic balance spring with an assembled balance equipped with a balance staff according to the invention makes it possible, for a magnetic field of 32 kA/m (400 G) to minimize the residual operation considerably, or even cancel it, the parasitic torque that disturbs the balance spring return torque then being caused by the presence of the magnetic components surrounding the oscillator.

By referring to the graph of FIG. 13 it will be found that adding a paramagnetic balance spring to an assembled balance equipped with a flange balance staff makes it possible, for a magnetic field B of 32 kA/m (400 G) to reduce the residual operation M by approximately a factor of 2 in relation to a same assembled balance combined with a balance spring of NIVAROX® alloy type. Surprisingly, it has been found that combining a paramagnetic balance spring with an assembled balance equipped with a flangeless balance staff, as proposed within the first alternative form of the first embodiment of the invention, makes it possible, for a magnetic field of 32 kA/m (400 G), to reduce the residual operation by approximately a factor of 12 in relation to the same assembled balance combined with a balance spring of NIVAROX® alloy type. It is also found that the oscillator of the first embodiment of the invention makes it possible, for a magnetic field of 32 kA/m (400 G), to reduce the residual operation very significantly, by approximately a factor of 17, in relation to an assembled balance comprising a flange staff and combined with a balance spring of NIVAROX® alloy type. Notably, as depicted in FIG. 13, for magnetic field strengths of between 15 and 32 kA/m, it was found that, in relation to the magnetic phenomenon, a synergistic effect occurs between the paramagnetic or diamagnetic balance spring and the geometry of the staff What happens is that the combined effect of the change of balance spring material and modified staff geometry goes beyond the sum of the individual effects of changing the balance spring material and of modifying the staff geometry.

Referring to the graph of FIG. 14 it may be seen that, surprisingly, combining a diamagnetic balance spring with an assembled balance equipped with a balance staff the maximum diameter of which is minimized, as is proposed within the first alternative form of the third embodiment of the invention, makes it possible, for a magnetic field B of 32 kA/m (400 G), to reduce the residual operation M very significantly, by approximately a factor of 35, in relation to an assembled balance comprising a flanged staff and combined with a balance spring of NIVAROX® alloy type.

Thus, the invention relates to an oscillator comprising a balance spring made of paramagnetic or diamagnetic material and an assembled balance within this oscillator comprising a shaft made of steel the maximum diameter of which is minimized on which are mounted a balance, a roller and the collet of said balance spring. In a first scenario, the collet may be attached to the balance spring. In that case it is preferably made of a copper-based alloy such as brass or CuBe2, or even of a stainless steel. In a second scenario, the collet may be manufactured as one with the balance spring, for example when the balance spring is made of silicon. The collet in this case is likewise made of silicon. The shaft is made of steel so as to withstand the mechanical stresses to which the oscillator is subjected. The roller and the balance are themselves machined from a paramagnetic or diamagnetic material, for example a copper-based alloy such as CuBe2 or brass, silicon or even nickel-phosphorus. For preference, the maximum diameter Dmax of the shaft is less than 3.5, even 2.5, or even 2 times the minimum diameter D1 of the shaft on which one of the elements of the oscillator is mounted. For preference also, the maximum diameter Dmax of the shaft is less than 2, or even 1.8, or even 1.6, or even 1.3 times the maximum diameter D2 of the shaft on which one of the elements of the oscillator is mounted. Thus, the residual effect is greatly minimized because the parasitic torque disturbing the balance spring return torque is then caused mainly by the presence of the magnetic components surrounding the oscillator. Of course, minimizing the residual effect may be taken even further if the components situated near to the oscillator according to the invention, for example the components of the escapement such as the pallet assembly or the escape-wheel are made of paramagnetic or diamagnetic materials.

According to a first embodiment of the invention, the smallest diameter D1 of the portion of the shaft on which one element of the oscillator (chosen from: collet, roller, balance) is mounted has a magnitude Dmax which corresponds to the largest diameter of the shaft. Moreover, the largest diameter D2 of the portion of the shaft on which an element of the oscillator is mounted also has a magnitude corresponding to that of the largest diameter Dmax of the shaft. Thus, in this first embodiment, Dmax=D1=D2.

According to a second embodiment of the invention the largest diameter D2 of the portion of the staff on which an element of the oscillator is mounted also corresponds to the diameter Dmax but differs from the smallest diameter D1 of the portion of the shaft on which an element of the oscillator is mounted. Thus, in this second embodiment, Dmax=D2>D1.

According to a third embodiment, the largest diameter D2 of the portion of the staff on which an element of the oscillator is mounted differs from the largest diameter of the staff Dmax but may be greater than or equal to the smallest diameter D1 of the portion of the shaft on which an element of the oscillator is mounted. Thus, in this third embodiment Dmax>D2≥D1

Figure 4:
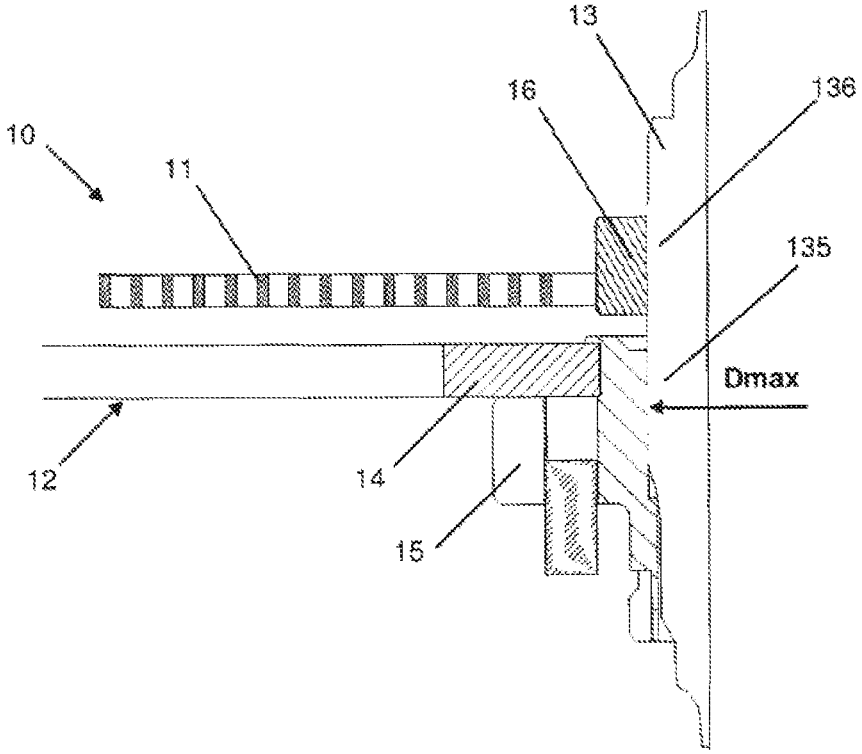
FIGS. 4 and 5 are views of a first alternative form of a first embodiment of an oscillator according to the invention.
Figure 5:
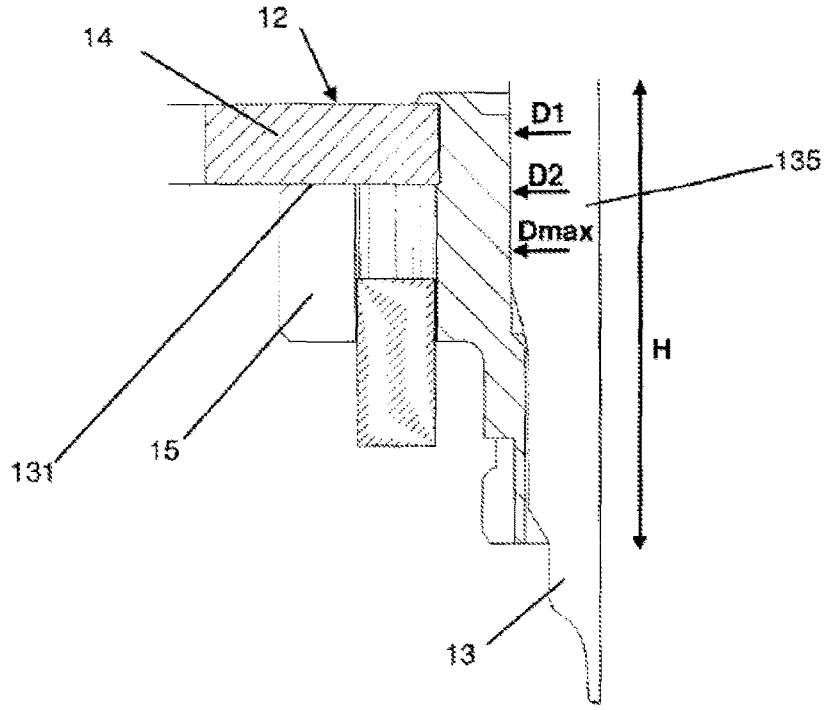

A first alternative form of the first embodiment of the oscillator according to the invention is described hereinafter with reference to FIGS. 4 and 5. The oscillator 10 comprises a balance spring 11 made of a paramagnetic or diamagnetic material and an assembled balance 12 comprising a shaft 13 on which are mounted a balance 14, a roller 15 and the collet 16 of said balance spring. In this first alternative form, the balance 14 is secured to the shaft 13 via the roller 15. The latter is attached, for example driven, onto a portion 135 and lines the shaft 13 over a height H. The diameter of this portion 135 is equal to the maximum diameter Dmax. The balance 14 is itself attached to the roller 15, for example by riveting, on a seating surface 131 made on the roller. The collet is itself mounted directly on the shaft. It may be fixed thereto for example by driving. The collet is mounted on a portion 136 of the shaft the diameter of which is equal to the maximum diameter Dmax of the shaft. In this first alternative form of the first embodiment the smallest diameter D1 of the portion of the shaft on which an element (chosen from: collet, roller, balance) is mounted corresponds to the magnitude Dmax which is equal to the largest diameter of the shaft. Moreover, the largest diameter D2 of the portion of the shaft on which an element is mounted also has a magnitude that coincides with that of the largest diameter of the shaft. Thus, in this first alternative form of the first embodiment, Dmax=D1=D2. This magnitude is of the order of 0.5 mm in the design illustrated in FIGS. 4 and 5.

Measurements have been taken for magnetic fields of different strengths so as to allow the residual operation of the first alternative form of the first embodiment of the oscillator to be compared with the residual operations of oscillators known from the prior art. It is found, as indicated in FIG. 13, that the mean residual operation of a movement provided with the first alternative form of the first embodiment of the oscillator, for a 32 kA/m magnetic field, is of the order of 2 s/d (curve 4 of the graph), namely approximately a factor of 12 smaller than that of a movement provided with a known oscillator equipped with a NIVAROX® alloy balance spring and a flangeless balance staff (curve 2 of the graph). It is also found that the mean residual operation of a movement provided with an oscillator equipped with an assembled balance provided with a flange balance staff, which is combined with a paramagnetic balance spring, for a magnetic field of 32 kA/m, is of the order of 15 s/d (curve 3 of the graph), namely approximately a factor of 2 smaller than that of a movement provided with the same assembled balance associated with a NIVAROX® alloy balance spring. Thus it is found that combining a paramagnetic balance spring with an assembled balance provided with a flangeless staff produces an unexpected effect on the residual operation of a movement, namely minimizes it appreciably or even cancels it for a 32 kA/m (400 G) magnetic field.

Furthermore, this factor can be increased if the number of magnetic components surrounding the oscillator within the movement in question is minimized.

Figure 6:
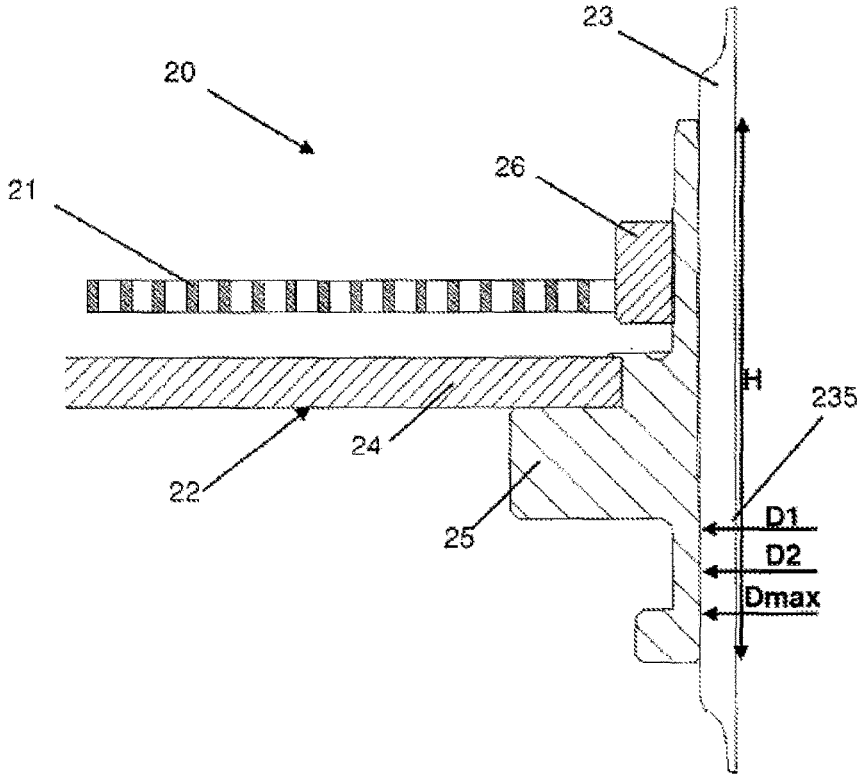
FIG. 6 depicts a second alternative form of a first embodiment of an oscillator according to the invention.

A second alternative form of the first embodiment of oscillator is described hereinafter with reference to FIG. 6. In this second alternative form, elements which are identical to or have the same function as the elements of the first alternative form have a "2" in the tens column in place of the "1" and the same numeral in the units. The parts or portions of these elements likewise have a "2" in the hundreds column in place of the "1" of the equivalent parts or portions of the elements of the first alternative form and have the same numeral in the tens column. Just as in the first alternative form of the first embodiment Dmax=D=D2. This magnitude is of the order of 0.3 mm in the design illustrated in FIG. 4. This second alternative form differs from the first alternative form in that the roller 25 lines the shaft over practically its entire length and/or in that the collet 26 is fixed to the shaft via the roller. In other words, the collet 26 is fixed to the roller 25 for example by driving.

Figure 2:
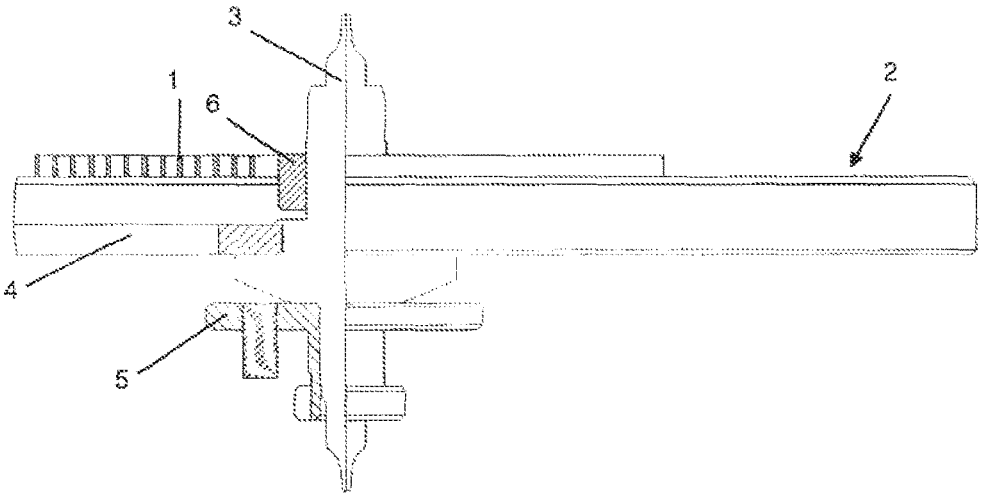
Figure 2 PRIOR ART
FIG. 2 is a view of an oscillator known from the prior art.
Figure 3:
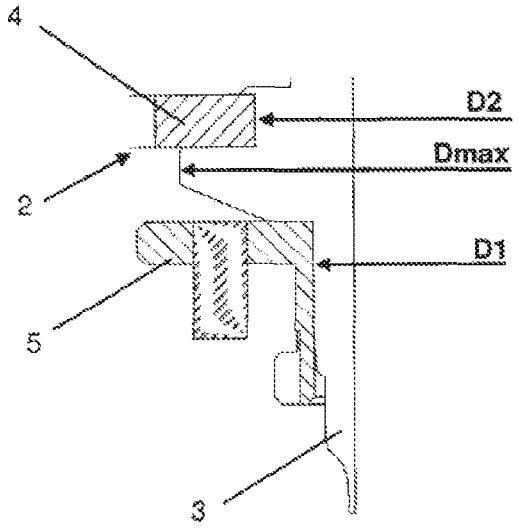
Figure 3 PRIOR ART
FIG. 3 is a detailed view of an assembled balance structure of the oscillator of FIG. 2.

Measurements show that this modification has very little impact on the minimizing of the residual effect. Whatever the alternative form considered, the mean residual operation, for a 32 kA/m magnetic field is 2 s/d, which represents a reduction by a factor of 8 in relation to that of a movement provided with a design known from the prior art as illustrated in FIGS. 2 and 3 and equipped with a paramagnetic balance spring.

According to the first two alternative forms of the first embodiment, the balance is secured to the shaft via the roller. Compared with the conventional structure known from the prior art, the shaft flange is thus omitted and the roller-balance assembly can be attached directly to the shaft, for example by driving. Alternatively, according to a third alternative form of the first embodiment, the balance is attached directly to a portion of the shaft the diameter of which is equal to those of the portions to which the roller and the collet are attached. Thus, the balance can be attached to the shaft independently of the roller.

Figure 7:
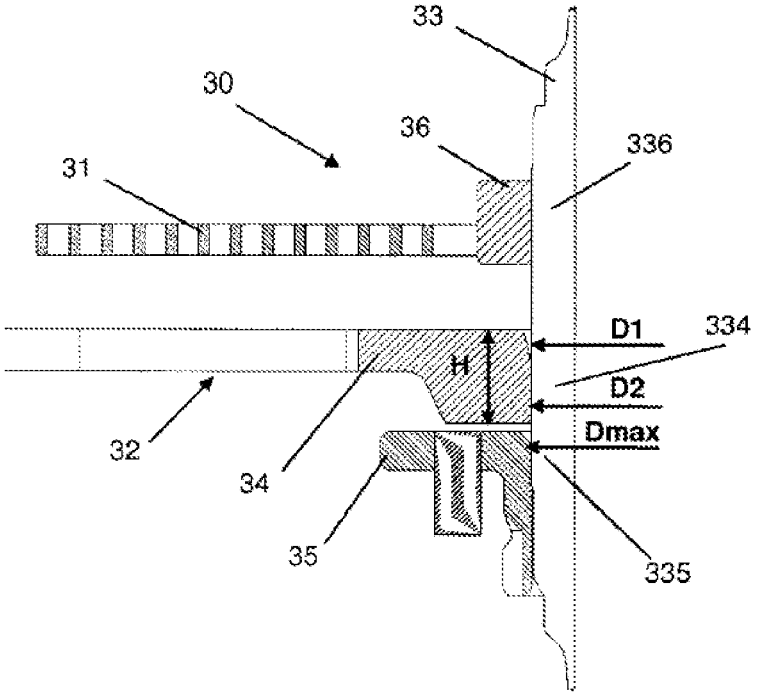
FIG. 7 depicts a third alternative form of a first embodiment of an oscillator according to the invention.

In this third alternative form of the first embodiment, which is illustrated by FIG. 7, elements which are identical to or have the same function as the elements of the first alternative form of the first embodiment have a "3" in the first column (tens or hundreds) in place of the "1" and have the same second numeral (units or tens). The balance 34 is fixed to a portion 334 independently of the roller 35 which is attached to a portion 335. To do that, the hub of the balance 34 has a sufficient overall height H, notably equal to or substantially equal to the height of the portion 334 such that it guarantees adequate seating and adequate retaining torque for the balance. The collet for its part is fixed to a portion 336, for example by driving. The diameter of each of the portions 334, 335, 336 is equal to the maximum diameter Dmax of the shaft. Thus, just as in the first two alternative forms, Dmax=D1=D2. This magnitude is of the order of 0.4 mm in the design illustrated by FIG. 7. Measurements show that the mean residual operation of a movement equipped with an oscillator produced according to this third alternative form, for a 32 kA/m magnetic field, is equivalent to that of a movement equipped with an oscillator produced according to one or other of the first two alternative forms, namely around 2 s/d.

Figure 8:
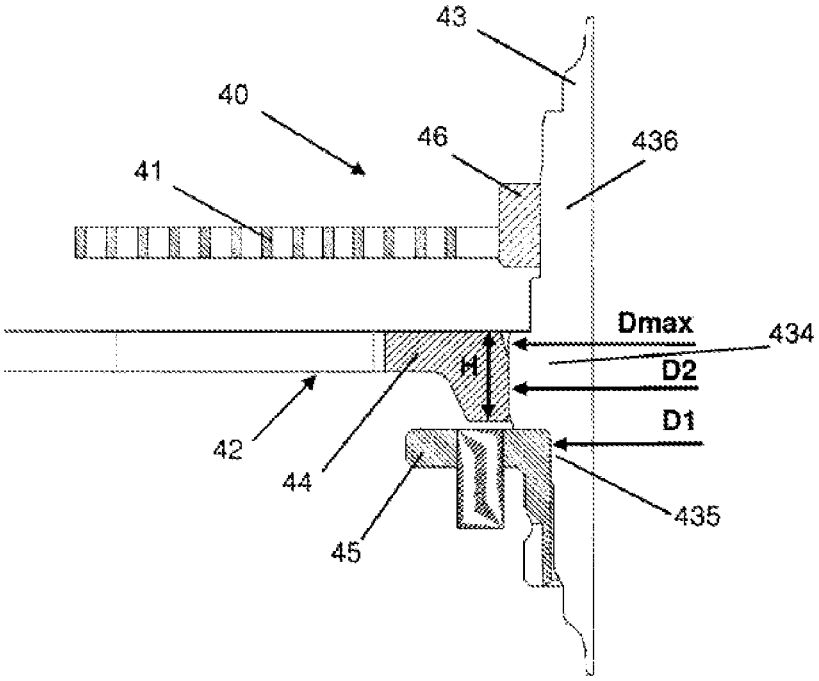
FIG. 8 is a view of an alternative form of a second embodiment of an oscillator according to the invention.

The second embodiment differs from the first embodiment in that the magnitude of the largest diameter of the shaft Dmax does not coincide with that of the minimum diameter D1 of the shaft on which one of the elements chosen from the collet, the roller and the balance is mounted. In other words, Dmax=D2>D1. An alternative form of the second embodiment of oscillator is described hereinafter with reference to FIG. 8. In this second embodiment, elements that are identical to or have the same function as the elements of the first alternative form of the first embodiment have a "4" in the first column (tens or hundreds) in place of the "1" and have the same second figure (units or tens). In this embodiment, the collet 46 is attached to the shaft 43 at a portion 436, for example by driving. The roller 45 is, for example, driven into abutment onto a portion 435. The diameter of this portion is equal to the minimum diameter D1 of the staff on which an element is mounted. The balance 44 is itself mounted directly on the shaft 43 at a portion 434, for example by driving, independently of the location of the roller 45. For that purpose, the hub of the balance 44 has a total height H that is sufficient, notably equal or substantially equal to the height of the portion 434, that it guarantees suitable seating and suitable retaining torque for the balance. The diameter of this portion 434 is equal to the maximum diameter D2 of the staff on which an element is mounted. It also corresponds to the diameter Dmax. Thus, in this embodiment, Dmax=D2>D1. For preference, the maximum diameter Dmax of the shaft is less than 3.5 or even 2.5 or even 2 times the minimum diameter D1 of the shaft on which one of the elements is mounted. In the example illustrated by FIG. 8, D1 is of the order of 0.4 mm, D2 and therefore Dmax are of the order of 0.8 mm. Thus, Dmax is less than approximately 2.5 times the diameter D1.

Measurements were taken for a 32 kA/m magnetic field so as to compare the residual operation of this alternative form of the second embodiment of the oscillator with that of an oscillator known from the prior art as illustrated in FIGS. 2 and 3, both being fitted with a paramagnetic balance spring. The table in FIG. 12 shows that the mean residual operation, for a magnetic field of this strength, is of the order of 2 s/d, namely an overall reduction by a factor of 8 relative to that of a movement provided with a known oscillator and fitted with a paramagnetic or diamagnetic balance spring.

The third embodiment differs from the second embodiment in that the magnitude of the largest diameter of the shaft Dmax does not correspond with that of the maximum diameter D2 of the shaft on which one of the elements chosen from collet, roller, balance, is mounted. Thus, Dmax>D2≥D1.

Figure 9:
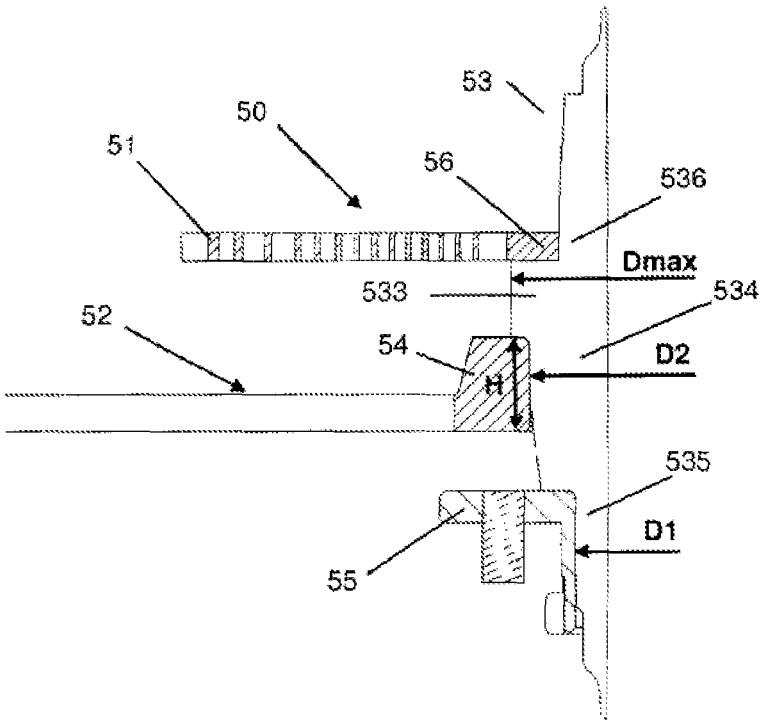
FIG. 9 is a view of a first alternative form of a third embodiment of an oscillator according to the invention.

A first alternative form of the third embodiment of oscillator according to the invention is described hereinafter with reference to FIG. 9. In this first alternative form of the third embodiment, elements which are identical to or have the same function as the elements of the first alternative form of the first embodiment have a "5" in the first column (tens or hundreds), in place of the "1" and have the same second figure (units or tens). The collet 56 is mounted directly on the shaft 53 at a portion 536, for example by driving. The roller 55 is also mounted directly on the shaft 53. It is, for example, driven into abutment on the shaft 53 at a portion 535. The diameter of this portion is equal to the minimum diameter D1 of the staff on which an element is mounted. The balance is attached to the shaft at a portion 534, for example by driving. For that purpose, the hub of the balance 54 has a sufficient total height H, notably equal or substantially equal to the height of the portion 534, that it guarantees suitable seating and suitable retaining torque for the balance. The diameter of this portion 534 is equal to the maximum diameter D2 of the staff on which an element is mounted. In this first alternative form of the third embodiment, a shaft portion 533 has a diameter Dmax greater than the diameters D1 and D2. Thus, this portion has shoulders against which the balance and/or the collet can bear when they are fixed to the shaft. In this way, the position of the balance and that of the collet can be defined with precision.

In this first alternative form of the third embodiment, Dmax>D2>D1 and the maximum diameter Dmax of the shaft is less than 3.5 or even 2.5 or even 2 times the minimum diameter D1 of the shaft on which one of the elements is mounted and/or the maximum diameter Dmax of the shaft is less than 2, 1.8 or even 1.6 or even 1.3 times the maximum diameter D2 of the shaft on which one of the elements is mounted. In the example illustrated by FIG. 9, D1 is of the order of 0.3 mm, D2 is of the order of 0.8 mm and Dmax is of the order of 1 mm. Thus, Dmax is less than approximately 3.5 times the diameter D1, and Dmax is less than approximately 1.3 times the diameter D2. In a design known from the prior art as depicted in FIGS. 2 and 3 in which Dmax>D2>D1, D1 is of the order of 0.3 mm, D2 is of the order of 0.8 mm, and Dmax is of the order of 1.4 mm. Dmax is therefore greater than more than 4.5 times the diameter D1, and Dmax is therefore greater than more than 1.6 times the diameter D2. It is therefore found that the greatest diameter of the shaft Dmax is very much minimized compared with the greatest diameter Dmax of a shaft equipping a known oscillator of the prior art. Thus, the residual effect is minimized because the parasitic torque that disturbs the spiral spring return torque is then mainly caused by the presence of the magnetic components surrounding the oscillator. FIG. 14 shows the residual operation of the first alternative form of the third embodiment of the oscillator compared with that of a known oscillator comprising a flanged balance staff and fitted with a balance spring of the NIVAROX® alloy type. It is found that the mean residual operation, for a 32 kA/m magnetic field, is of the order of 1 s/d, which is a very significant reduction by a factor of 35 relative to that of a movement provided with the abovementioned oscillator.

Figure 10:
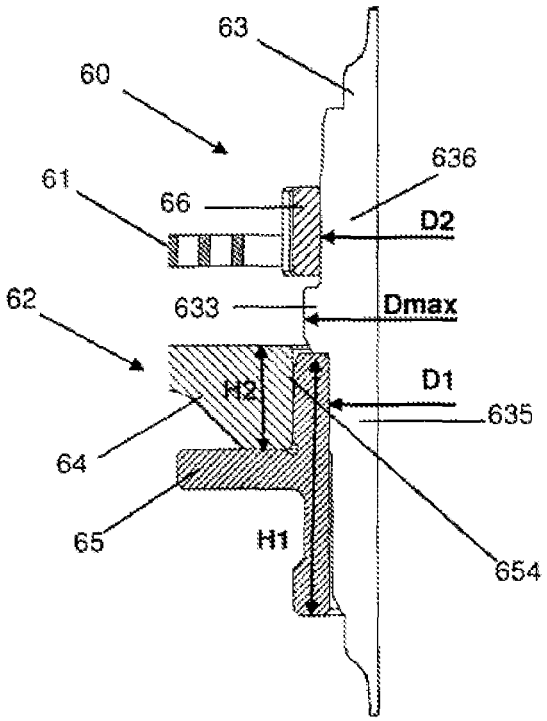
FIG. 10 is a view of a second alternative form of a third embodiment of an oscillator according to the invention.

A second alternative form of the third embodiment of the oscillator according to the invention is described hereinafter with reference to FIG. 10. In this second alternative form of the third embodiment the elements that are identical to or have the same function as the elements of the first alternative form of the first embodiment have a "6" in the first column (tens or hundreds) in place of the "1" and have the same second figure (units or tens). As in the first alternative form of the third embodiment, Dmax>D2>D1. This second alternative form differs from the first alternative form in that the balance 64 is secured to the shaft 63 via the roller 65. The latter is attached, for example by driving, to a portion 635 and lines the shaft 63 over a height H1. The diameter of this portion 635 is equal to the minimum diameter D1 of the shaft on which an element of the oscillator is mounted. The balance is mounted in abutment on the roller, for example by driving. For this reason, the hub of the balance 64 has a total height H2 that is sufficient, notably equal or substantially equal to the height of the portion 654 of the roller 65, that it guarantees suitable seating and a suitable retaining torque of the balance. The collet is itself fixed to a portion 636 of the shaft 63, for example by driving. The diameter of this portion 635 is equal to the maximum diameter D2 of the shaft on which an element of the oscillator is mounted. In this second alternative form of the third embodiment, a shaft portion 633 has a diameter Dmax greater than the diameters D1 and D2. Thus, this portion has shoulders against which the roller and/or the collet can bear when they are fixed to the shaft. In this way, the position of the balance and that of the collet can be defined with precision. In this second alternative form of the third embodiment, Dmax>D2>D1 and the maximum diameter Dmax of the shaft is less than 3.5 or even 2.5 or even 2 times the minimum diameter D1 of the shaft on which one of the elements is mounted and/or the maximum diameter Dmax of the shaft is less than 2, 1.8 or even 1.6 or even 1.3 times the maximum diameter D2 of the shaft on which one of the elements is mounted. In the example illustrated by FIG. 10, D1 is of the order of 0.4 mm, D2 is of the order of 0.5 mm and Dmax is of the order of 0.7 mm. Thus, Dmax is less than approximately 2 times the diameter D1 and Dmax is less than approximately 1.6 times the diameter D2. In this way, the largest diameter Dmax of the shaft is likewise greatly minimized.

A third alternative form of the third embodiment differs from the first two alternative forms in that the magnitude of the maximum diameter D2 of the shaft on which an element of the oscillator is mounted is equal to that of the minimum diameter D1 on which an element of the oscillator is mounted. This alternative form is described hereinafter with reference to FIG. 11. Elements that are identical to or have the same function as the elements of the first alternative form of the first embodiment have a "7" in the first column (tens or hundreds) in place of the "1" and have the same second figure (units or tens). As in the second alternative form of the third embodiment, the balance 74 is secured to the shaft 73 via the roller 75. The latter is attached, for example by driving, onto a portion 735 and lines the shaft 73 over a height H1. The diameter of this portion 735 is equal to the minimum diameter D1 of the shaft on which an element of the oscillator is mounted. The diameter of this portion 735 also corresponds to the maximum diameter D2 of the shaft on which an element of the oscillator is mounted. The balance is mounted in abutment on the roller, for example by driving. For this purpose, the hub of the balance 74 has a total height H2 that is sufficient, notably equal or substantially equal to the height of the portion 754 of the roller 75, that it guarantees a suitable seating and suitable retaining torque for the balance. The collet is itself fixed to a portion 736 of the shaft 73, for example by driving. The diameter of this portion 736 corresponds to the maximum diameter D2 of the shaft on which an element of the oscillator is mounted and also corresponds to the minimum diameter D1 of the shaft on which an element of the oscillator is mounted. Thus, D1=D2. In this third alternative form, a shaft portion 733 has a diameter Dmax greater than the diameters D1 and D2. Thus, this portion has shoulders against which the roller and/or the collet are able to bear when they are fixed to the shaft. In this way, the position of the balance and that of the collet can be defined with precision. In this third alternative form Dmax>D1=D2, and the maximum diameter Dmax of the shaft is less than 3.5 or even 2.5 or even 2 times the minimum diameter D1 of the shaft on which one of the elements is mounted and the maximum diameter Dmax of the shaft is less than 2, 1.8 or even 1.6 or even 1.3 times the maximum diameter D2 of the shaft on which one of the elements is mounted. In the example illustrated in FIG. 11, D1 and D2 are of the order of 0.4 mm, and Dmax is of the order of 0.7 mm. Thus, Dmax is less than approximately 2 times the diameter D1 and Dmax is less than approximately 2 times the diameter D2. In this way, the largest diameter Dmax of the shaft is also greatly minimized.

In the third embodiment, Dmax is preferably the diameter of a seating into contact with which one element or even two elements (roller, balance, collet) can be driven on the staff.

Whatever the embodiment, when a first element, for example the balance, is not mounted directly on the shaft but is mounted on the second element, itself mounted directly on the shaft at a first portion of the shaft having a first diameter, the diameter of the shaft on which the first element is mounted is considered to be the first diameter. Of course, whatever the embodiment considered, all the elements chosen from the collet, roller, balance can be arranged on one of the three diameters D1, D2, Dmax.

In the various embodiments, the diameter Dmax is preferably less than 1.1 mm or even less than 1 mm or even less than 0.9 mm.

The oscillator according to the invention equipped with a paramagnetic (Nb—Zr—O alloy, for example PARACHROM® alloy) or diamagnetic (notably silicon covered with a layer of $SiO_2$) balance spring has the special feature of being provided with a balance shaft which is made of profile turning steel the geometry of which has been modified in such a way as to minimize the residual effect. The roller and the balance are themselves machined from a paramagnetic or diamagnetic material, for example a copper-based alloy such as CuBe2 or brass, silicon or even nickel-phosphorus. The roller, according to the embodiment considered, is preferably adapted so as to allow the balance to be assembled.

In this document, a "first element secured to a second element" means that the first element is fixed to the second element.

In this document, an "assembled balance" means an assembly comprising or consisting of a balance staff, a balance, a roller and a collet, the balance, the roller and the collet being mounted on the balance staff.

In this document, "staff" and "shaft" denote the same element.

In this document, the ratios of residual operation values are given in absolute terms.

Figure 1:
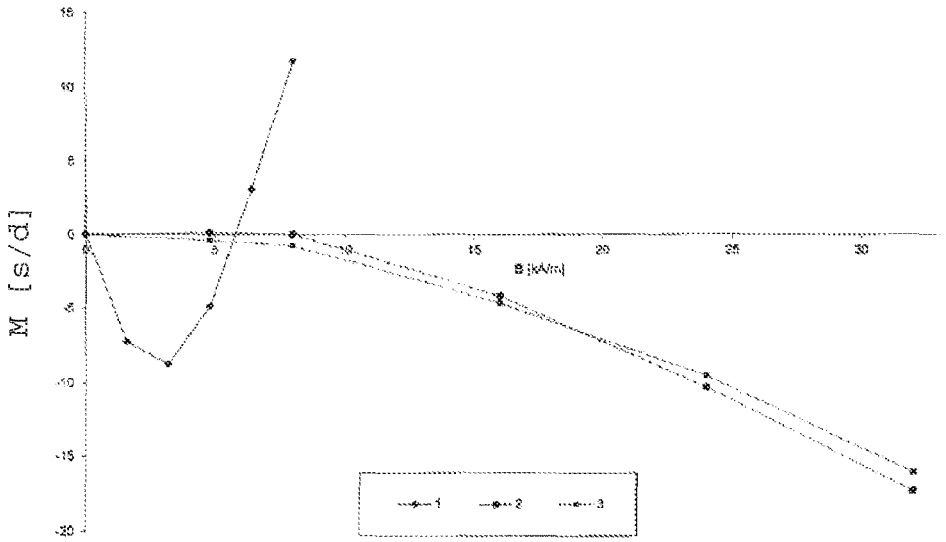

The graphs in FIGS. 1, 13 and 14 are drawn to scale, so that values, notably residual operation values, can be deduced therefrom by reading them off the graph.

The invention claimed is:

1. An antimagnetic oscillator resistant to strong magnetic fields, comprising a balance spring made of a paramagnetic or diamagnetic material and an assembled balance comprising a shaft on which the following elements are mounted: a balance, a roller and a collet secured to said balance spring, wherein each of the elements is mounted on a lined portion of the shaft, and the lined portion(s) form a continuous or discontinuous portion of the shaft on which the elements are mounted, wherein the portion of the shaft on which the elements are mounted has a minimum diameter and a maximum diameter, wherein the shaft has a geometry wherein a maximum diameter of the shaft is at least one of (i) less than 3.5 the minimum diameter of the portion of the shaft on which the elements are mounted and (ii) less than 1.6 the maximum diameter of the portion of the shaft on which the elements are mounted, and wherein the shaft is made of steel, wherein the paramagnetic or diamagnetic material of the spring and the geometry of the shaft have a combined effect that synergistically reduces a mean residual operation of the oscillator, when subjected to a magnetic field substantially stronger than 4.8 kA/m.

2. The oscillator as claimed in claim 1, wherein the maximum diameter of the shaft on which one of the elements is mounted is equal to the maximum diameter of the shaft.

3. The oscillator as claimed in claim 1, wherein the maximum diameter of the portion of the shaft on which the elements are mounted and the minimum diameter of the portion of the shaft on which the elements are mounted and the maximum diameter of the shaft are equal.

4. The oscillator as claimed in claim 1, wherein the maximum diameter of the shaft is less than 1.1 mm.

5. The oscillator as claimed in claim 1, wherein the balance is mounted directly on the shaft.

6. The oscillator as claimed in claim 1, wherein the balance is mounted on the roller.

7. The oscillator as claimed in claim 1, wherein the collet is mounted on the roller.

8. The oscillator as claimed in claim 1, wherein the balance shaft is cylindrical or substantially cylindrical.

9. A clock movement comprising an oscillator as claimed in claim 1.

10. A timepiece comprising a clock movement as claimed in claim 9.

11. A timepiece comprising an oscillator as claimed in claim 1.

12. The oscillator as claimed in claim 1, wherein the mean residual operation of the oscillator, when subjected to a 32 kA/m magnetic field, is at least 8 times lower than a residual operation of an oscillator having the same shaft and a balance spring made of a non-paramagnetic and non-diamagnetic alloy.

13. The oscillator as claimed in claim 1, wherein the mean residual operation of the oscillator, when subjected to a 32 kA/m magnetic field, is at most 2 s/d.

14. The oscillator as claimed in claim 1, wherein the roller and the balance are made of a paramagnetic or diamagnetic material.

15. The oscillator as claimed in claim 1, wherein the paramagnetic or diamagnetic material of the spring and the geometry of the shaft have a combined effect so that, for a magnetic field of 15 to 32 KA/m, the residual effect is reduced by a factor of at least 6 as compared to a shaft having a flanged geometry according to norm NIHS 34-01.

16. An antimagnetic oscillator resistant to strong magnetic fields, comprising a balance spring made of a paramagnetic or diamagnetic material and an assembled balance comprising a shaft on which the following elements are mounted: a balance, a roller and a collet secured to said balance spring, wherein each of the elements is mounted on a lined portion of the shaft, and the lined portion(s) form a continuous or discontinuous portion of the shaft on which the elements are mounted, wherein the portion of the shaft on which the elements are mounted has a minimum diameter and a maximum diameter, wherein the shaft has a geometry wherein a maximum diameter of the shaft is (i) less than 3.5 times the minimum diameter of the portion of the shaft on which the elements are mounted and (ii) less than 2 times the maximum diameter of the portion of the shaft on which the elements are mounted, and wherein the shaft is made of steel, wherein the paramagnetic or diamagnetic material of the spring and the geometry of the shaft have a combined effect that synergistically reduces a mean residual operation of the oscillator, when subjected to a magnetic field substantially stronger than 4.8 kA/m.

17. The oscillator as claimed in claim 16, wherein the maximum diameter of the portion of the shaft on which the elements are mounted is equal to the maximum diameter of the shaft.

18. The oscillator as claimed in claim 16, wherein the maximum diameter of the portion of the shaft on which the elements are mounted and the minimum diameter of the portion of the shaft on which the elements are mounted and the maximum diameter of the shaft are equal.

19. The oscillator as claimed in claim 16, wherein the maximum diameter of the shaft is less than 1.1 mm.

20. The oscillator as claimed in claim 16, wherein the balance is mounted directly on the shaft.

21. The oscillator as claimed in claim 16, wherein the balance is mounted on the roller.

22. The oscillator as claimed in claim 16, wherein the collet is mounted on the roller.

23. The oscillator as claimed in claim 16, wherein the balance shaft is cylindrical or substantially cylindrical.

24. A clock movement comprising an oscillator as claimed in claim 16.

25. A timepiece comprising a clock movement as claimed in claim 24.

26. A timepiece comprising an oscillator as claimed in claim 16.

27. The oscillator as claimed in claim 16, wherein a mean residual operation of the oscillator, when subjected to a 32 kA/m magnetic field, is at least 8 times lower than a residual operation of an oscillator having the same shaft and a balance spring made of a non-paramagnetic and non-diamagnetic alloy.

28. The oscillator as claimed in claim 16, wherein the mean residual operation of the oscillator, when subjected to a 32 kA/m magnetic field, is at most 2 s/d.

* * * * *